US007510465B2

(12) United States Patent
Chung et al.

(10) Patent No.: US 7,510,465 B2
(45) Date of Patent: Mar. 31, 2009

(54) SAND PAD LOCK FOR SANDER

(75) Inventors: Koon For Chung, Sai Kung (HK); Hoi Pang Wang, Tseung Kwan O (HK); Wai Keung Lo, Tuen Mun (HK)

(73) Assignee: Eastway Fair Company Limited (VG)

( * ) Notice: Subject to any disclaimer, the term of this patent is extended or adjusted under 35 U.S.C. 154(b) by 0 days.

(21) Appl. No.: 11/695,977

(22) Filed: Apr. 3, 2007

(65) Prior Publication Data

US 2007/0184763 A1 Aug. 9, 2007

Related U.S. Application Data

(63) Continuation of application No. PCT/IB2005/003458, filed on Nov. 18, 2005.

(51) Int. Cl.
*B24B 23/00* (2006.01)

(52) U.S. Cl. ..... 451/358; 451/359; 451/360; 451/510

(58) Field of Classification Search ..... 451/359, 451/508, 509, 510, 358, 360
See application file for complete search history.

(56) References Cited

U.S. PATENT DOCUMENTS 789,568 A * 5/1905 Roe et al. ..... 292/57
2,620,604 A * 12/1952 Veit ..... 451/509
3,743,336 A * 7/1973 Andrews ..... 292/173
4,706,478 A * 11/1987 Swan et al. ..... 70/28
4,774,788 A 10/1988 Shacham
5,015,019 A * 5/1991 Razdolsky ..... 292/200
5,263,283 A * 11/1993 Rudolf et al. ..... 451/344
5,339,571 A 8/1994 Timmons et al.
5,518,441 A 5/1996 Valentini
5,718,621 A 2/1998 Turley
5,839,950 A * 11/1998 Johansson Edling et al. ..... 451/359
5,941,765 A 8/1999 Taylor
6,116,996 A 9/2000 Yanase
6,554,554 B1 4/2003 Matthews
6,651,467 B1 * 11/2003 Weinerman et al. ..... 70/208
6,893,335 B2 5/2005 Mackay (Continued)

FOREIGN PATENT DOCUMENTS

CN 2335741 Y 1/1999

(Continued)

OTHER PUBLICATIONS

International Search Report and Written Opinion for priority PCT application PCT/IB2005/003458 dated Aug. 10, 2006.

(Continued)

*Primary Examiner*—Maurina Rachuba
(74) *Attorney, Agent, or Firm*—Michael Best & Friedrich LLP

(57) ABSTRACT

A lock formed from a body and a projection that is inserted into the aperture in the spindle to rotatably connect a sanding pad to the housing. The lock may include an arm rotatably mounted to the body that is movable between a first position wherein the arm can be manipulated to rotate the body with respect to the spindle and a second position where the arm is contained within the body.

16 Claims, 7 Drawing Sheets

U.S. PATENT DOCUMENTS

| | | | | |
|---|---|---|---|---|
| 7,344,435 | B2 * | 3/2008 | Pollak et al. | 451/358 |
| 2003/0190877 | A1 * | 10/2003 | Gallagher et al. | 451/359 |

FOREIGN PATENT DOCUMENTS

| | | | |
|---|---|---|---|
| CN | 237 2094 | | 4/2000 |
| CN | 2455441 | Y | 10/2001 |
| CN | 1077826 | C | 1/2002 |
| CN | 2481455 | Y | 3/2002 |
| CN | 2552635 | Y | 5/2003 |
| CN | 2602882 | Y | 2/2004 |
| CN | 1167535 | C | 9/2004 |
| CN | 2642470 | Y | 9/2004 |
| CN | 2661383 | Y | 12/2004 |
| CN | 1196564 | C | 4/2005 |
| DE | 299 230 17 | | 3/2000 |
| EP | 02 378 56 | | 9/1987 |
| EP | 03 815 57 | | 8/1990 |
| WO | WO 98/43779 | | 10/1998 |

OTHER PUBLICATIONS

International Preliminary Report on Patentability for priority PCT application PCT/IB2005/003458 dated May 29, 2008.

* cited by examiner

SAND PAD LOCK FOR SANDER

This application is a continuation of and claims priority to PCT application PCT/IB2005/003458 filed on Nov. 18, 2005, the entire contents of which are fully incorporated by reference herein.

BACKGROUND

The present invention relates to rotary or oscillating power tools, and in particular to hand held rotary or oscillating sanders. A typical hand held rotary or oscillating tool, such as a palm sander, includes a housing that encloses a motor with an output shaft that is connected to a spindle. The spindle is connected to a plate that rotates or oscillates along with the spindle and carries a sheet of sandpaper for engagement with a work surface. When this type of design is used with other types of hand tools, the plate can carry other types of working surfaces, such as grinding wheels, buffing pads, etc. Because the sheet of sandpaper contacts the workpiece during use, frictional forces are created with the sandpaper and requires periodic replacement of the sandpaper to allow for efficient operation of the tool.

Often, it is convenient or desirable to remove the plate from the tool to replace the sandpaper (or other working surface). In typical hand held rotary or oscillating tools, it is a time consuming evolution to remove the plate from the spindle, and often requires the use of external tools, such as screwdrivers or allen wrenches. The time that this evolution requires and the need for external tools at the worksite (that often serve no purpose other than removing the plate from the spindle) reduces the over all efficiency of the task. Therefore, it is desired to provide a sander, or similar tool with a rotating or oscillating plate that retains a working surface, where the plate can be quickly removed and replaced without the use of any external tools.

BRIEF SUMMARY

The present invention provides a sander for operation on a workpiece. The sander includes a housing that surrounds a motor and a spindle that includes an aperture and rotates with the rotation of the output shaft of the motor. The sander additionally includes a sanding pad that is capable of receiving and supporting a sheet of sandpaper for sanding a workpiece. A lock that includes a body and a projection is inserted into an aperture in the spindle to rotatably connect the sanding pad to the housing.

Advantages of the present invention will become more apparent to those skilled in the art from the following description of the preferred embodiments of the invention that have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION

Referring now to FIGS. 1-5, a lock according to the present invention is shown in use on a sander 10. While the lock of the present invention will be described in conjunction with a sander and find particular use with a sander, it should be understood that the invention can be used with other tools. For example, the lock of the present invention can be successfully implemented with a rotary grinder or with a rotary buffer or polisher. As will be understood by those of skill in the art after reviewing and comprehending this application, the present inventive concept can be used in a wide variety of rotary or oscillating tools or devices.

The sander 10 includes a housing 12, a motor (not shown) positioned within the housing 12 and capable of rotation when a source of power is supplied to the motor. As understood by those of ordinary skill in the art, the motor can be powered from an external source of power such as electrical power. In this regard, the electrical source can be AC current or DC current from a battery rechargeable or otherwise that is connected to the sander 10. The sander 10 further includes a grip or handle 14 that provides an ergonomic structure for the user to hold to manipulate the sander 10.

Figure 1:
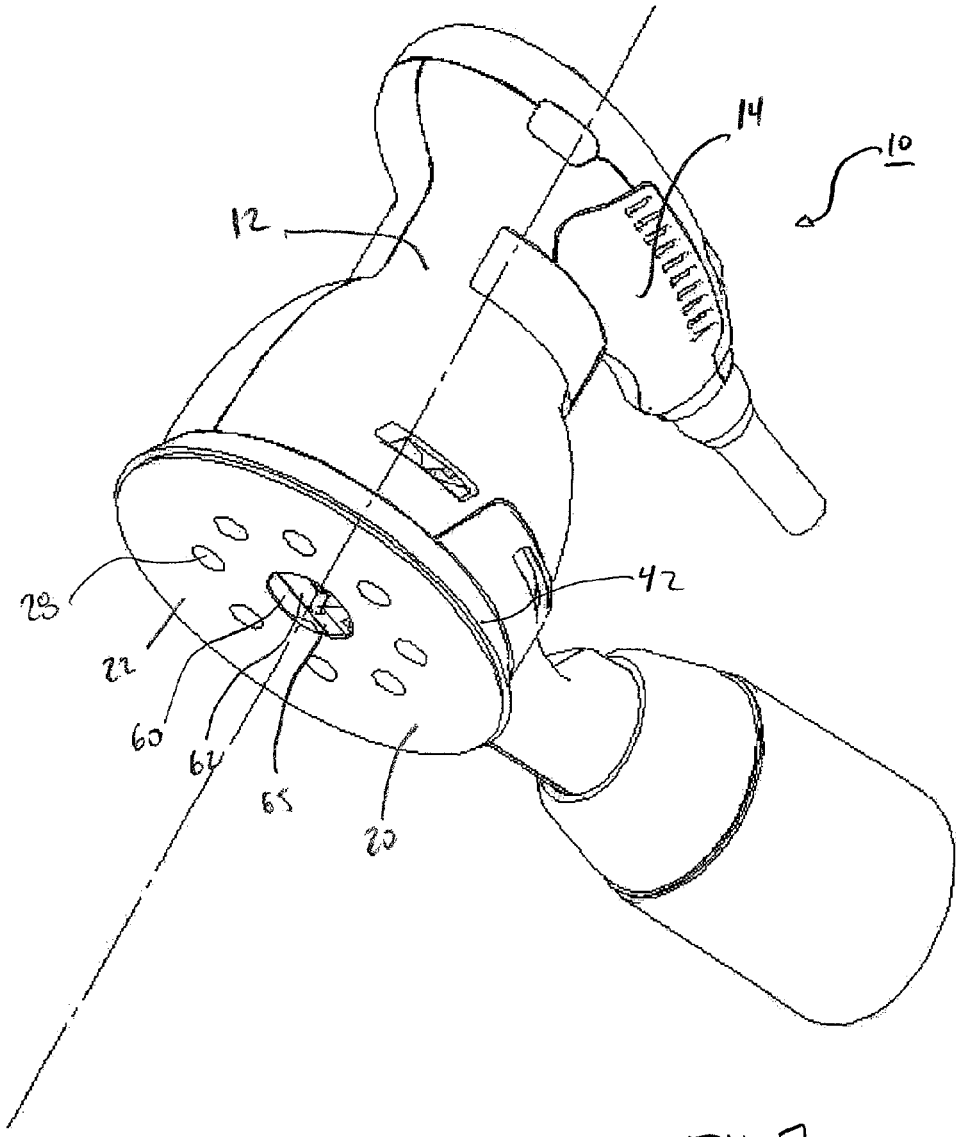
FIG. 1 is a bottom perspective view of a sander showing the lock of the present invention in the locked or use position.
Figure 2:
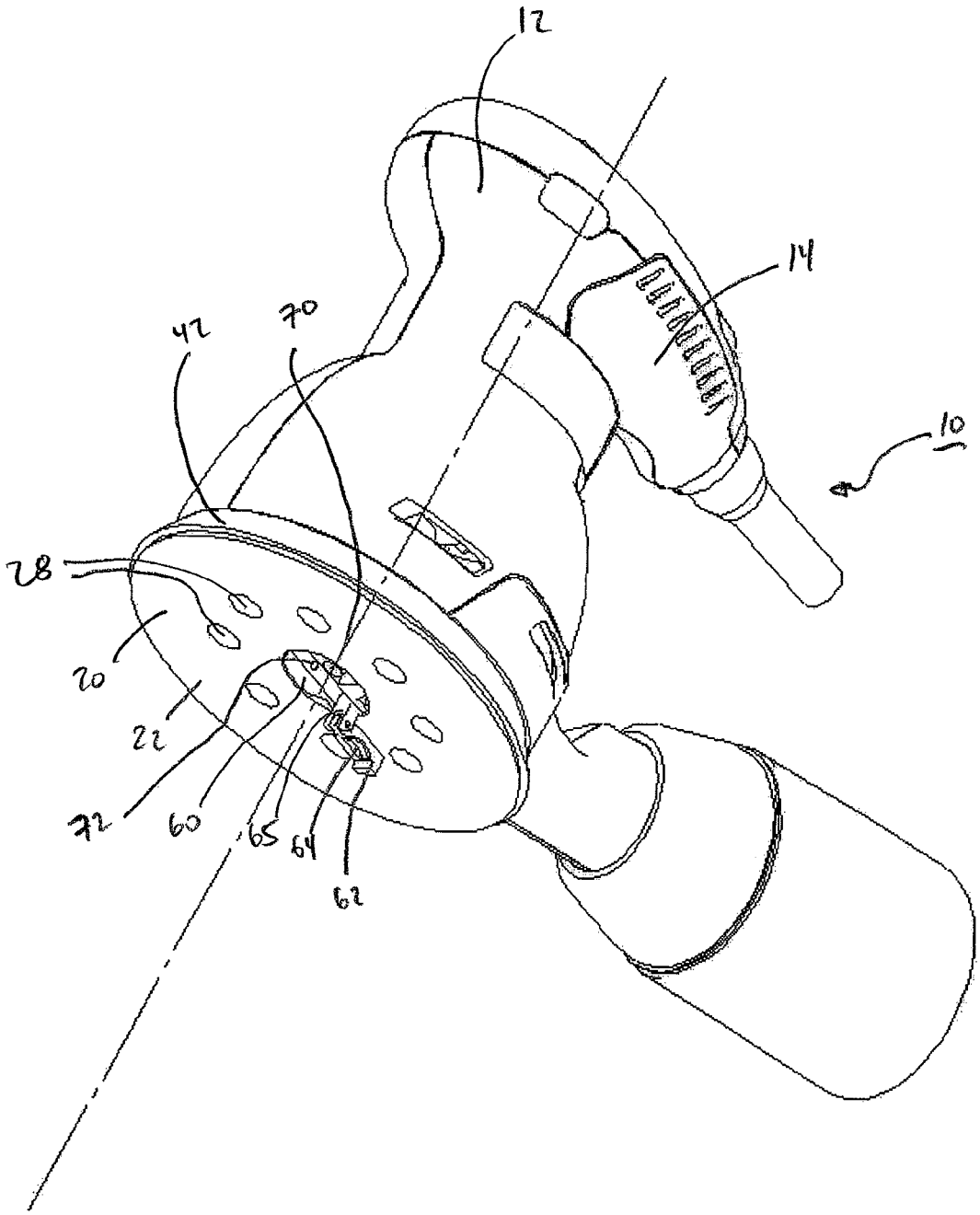
FIG. 2 is a bottom perspective view of the sander of FIG. 1 showing the lock in an unlocked positioned for disengagement of the sanding pad.
Figure 3:
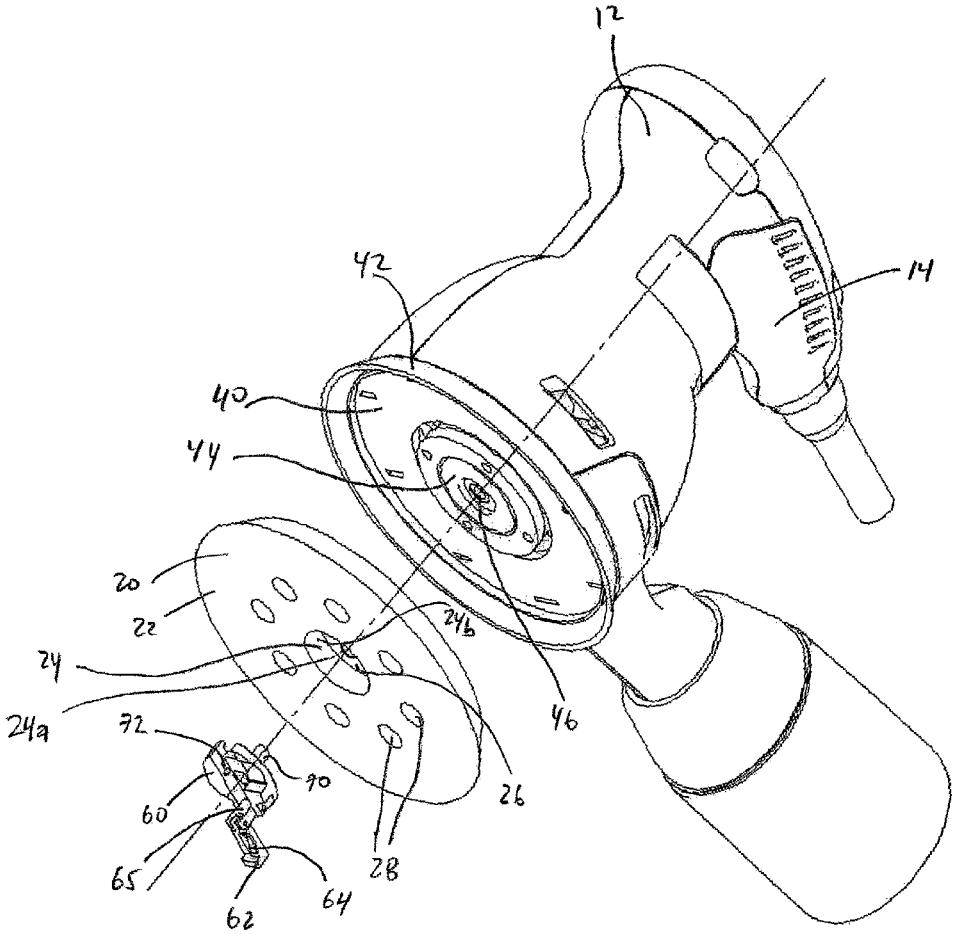
FIG. 3 is an exploded view of the components of the lock of the present invention used on a sander.

The motor is rotatably connected to the spindle 44, shown in FIG. 3. In some embodiments, the sander 10 may include a transmission (not shown) between the output shaft of the motor and the spindle 44 to change the angular velocity and torque of the spindle 44 from what is produced in the output shaft. Alternatively, the sander 10 may use a transmission or gear train to allow the longitudinal axis of the spindle 44 to be arranged in a different orientation than the longitudinal axis of the motor shaft.

The bottom of the sander 10 includes a receiving surface 40 that preferably is flush with the bottom of the spindle 44. The receiving surface does not rotate with the motor, but provides a support surface for the sanding pad 20 as it rotates (or oscillates) with an operative connection with the spindle 44. The sanding pad 20 is removeably retained on the spindle 44 with a lock 60.

The sanding pad 20 is generally formed as a plate with at least one aperture 24 therethrough. The aperture 24 is sized to accept the lock 60, which is discussed in detail below. As shown in FIG. 3, the aperture 24 is formed with a through hole 24*a* of a radius slightly larger than the projection 70 of the lock 60, and a blind hole 24*b* with a radius slightly larger than the radius of the lock body 61. The sanding pad 20 therefore forms a ledge 26, which is the surface below the blind hole 24*b* that the lock body 61 rests on when installed in the sander 10. The depth of the blind hole 24*b* is preferably slightly larger than the depth of the lock 60 so that the lock 60 is slightly recessed below the bottom surface 22 of the sanding pad 20 when the lock 60 and the sanding pad 20 are installed on the sander 10.

As mentioned above, the sanding pad 20 accepts and retains a sheet of sand paper (not shown) on the bottom surface 22 of the sanding pad 20. In some embodiments, the sanding pad 20 may include a plurality of holes 28 that are located radially around the sanding pad 20 to provide channels for extraction of dust from the work surface, and to reduce the material requirements and weight of the sanding pad 20.

Figure 4:
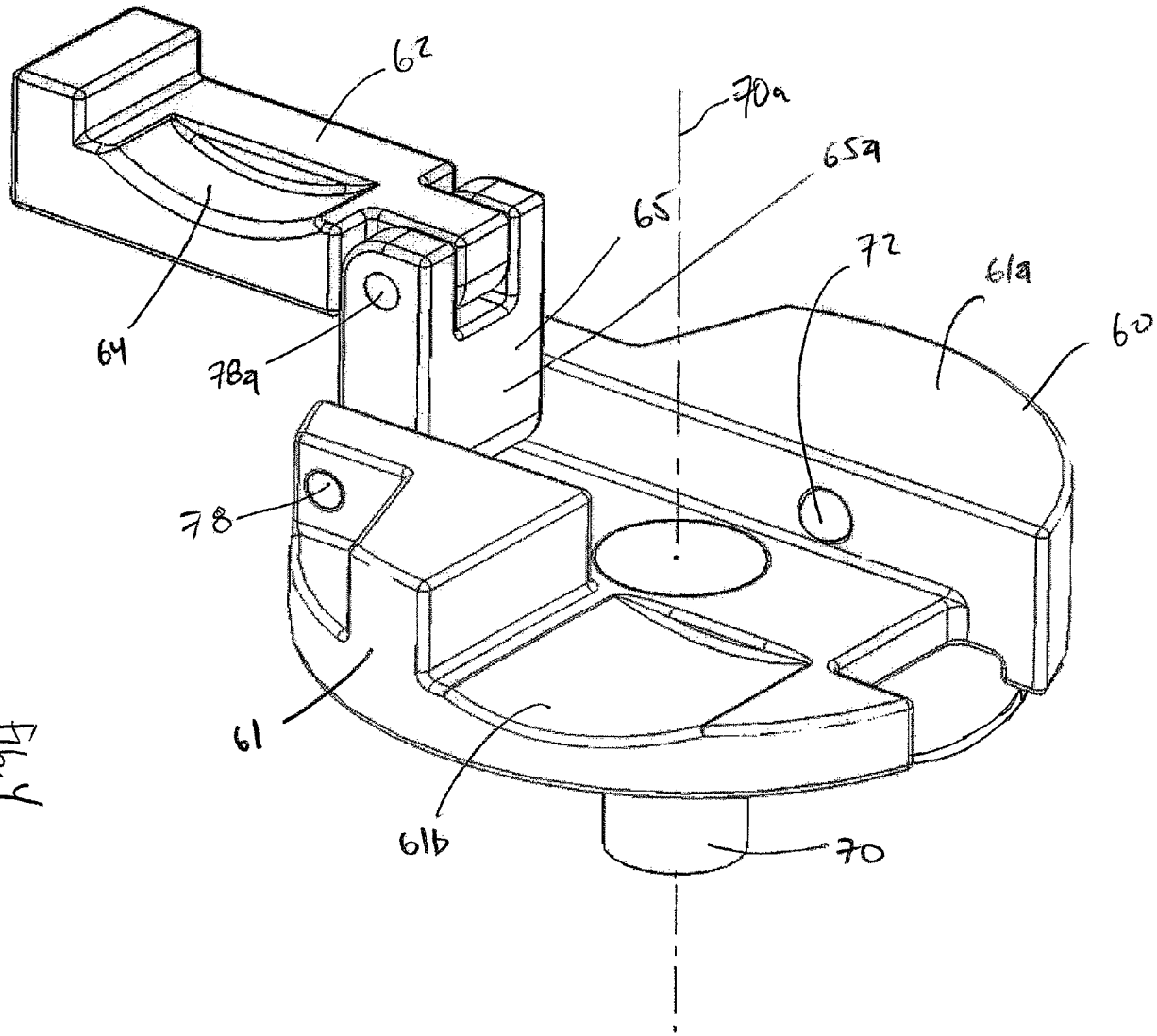
FIG. 4 is a perspective view of the lock of the present invention with the arm in a first position to rotate the lock body.
Figure 5:
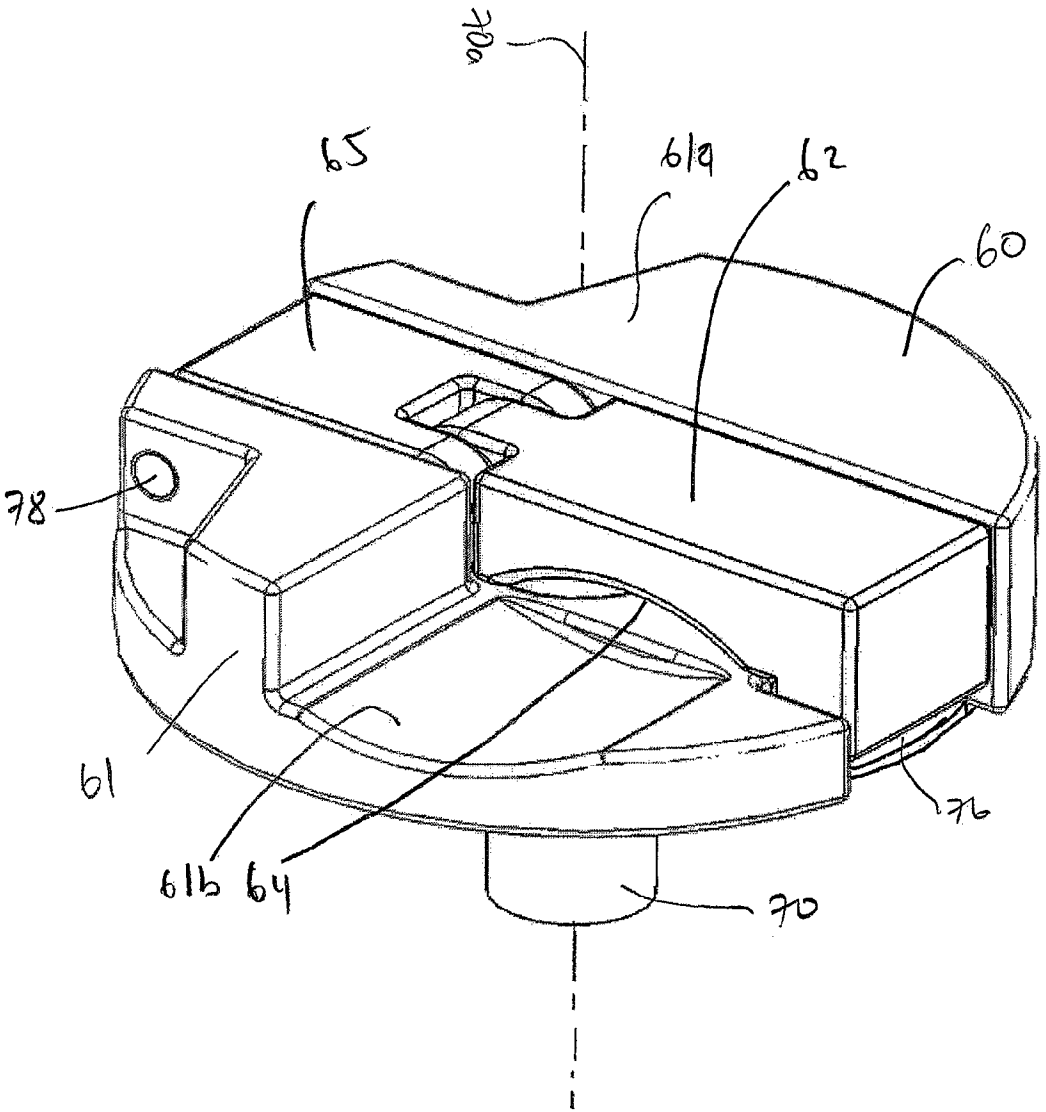
FIG. 5 is a perspective view of the lock of FIG. 4 with the arm in a second position to maintain the position of the lock body.

The lock 60 is best shown in FIGS. 4 and 5. The lock 60 is formed from a generally disk shaped lock body 61. As mentioned above, the lock body 61 has a slightly smaller radius and depth than the blind hole 24*b* so that the lock body 61 can be completely contained within the blind hole 24*b*. The lock 60 also includes a cylindrical projection 70 that extends from a bottom surface (not shown) of the lock body 61 and can be inserted into the aperture 46 in the spindle 44. In a preferred embodiment, the projection 70 is threaded and the aperture 46 is tapped with corresponding threads to allow the lock 60 to be rotated with respect to the spindle 44. As can be understood, the threads on the projection 70 and the aperture 46 are threaded in an opposite direction than the motor spins the spindle 44, so that rotation of the spindle 44 serves to tighten the connection between the projection 70 from the lock and the spindle 44.

The lock 60 further includes an arm 62 that is preferably rotatably connected to a post 65 with a pinned connection 78*a*, or similar connection that is known to those of ordinary skill in the art to allow one member to rotate with respect to a second member. The post 65 is rotatably connected to the lock body 61 with a second pinned connection 78. As can be understood with reference to FIGS. 4 and 5, the arm 62 and the post 65 can be rotated to so that the arm 62 reaches a first position shown in FIG. 4 where the arm 62 extends outward in a direction parallel to and above a top surface 61*a* of the lock body 61. Additionally, the arm 62 and the post 65 can be rotated (as shown in FIG. 5) so that the arm 62 is contained within the outer dimensions of the lock body 61, with the arm 62 extending in parallel and below the top surface 61*a* of the lock body 61. As can also be understood, the post 65 is rotatable from a position where the post 65 is perpendicular to the top surface 61*a* of the lock body 61 (first position shown in FIG. 4) to a position where it is parallel to the top surface 61*a* of the lock body 61 (second position shown in FIG. 5).

Figure 6:
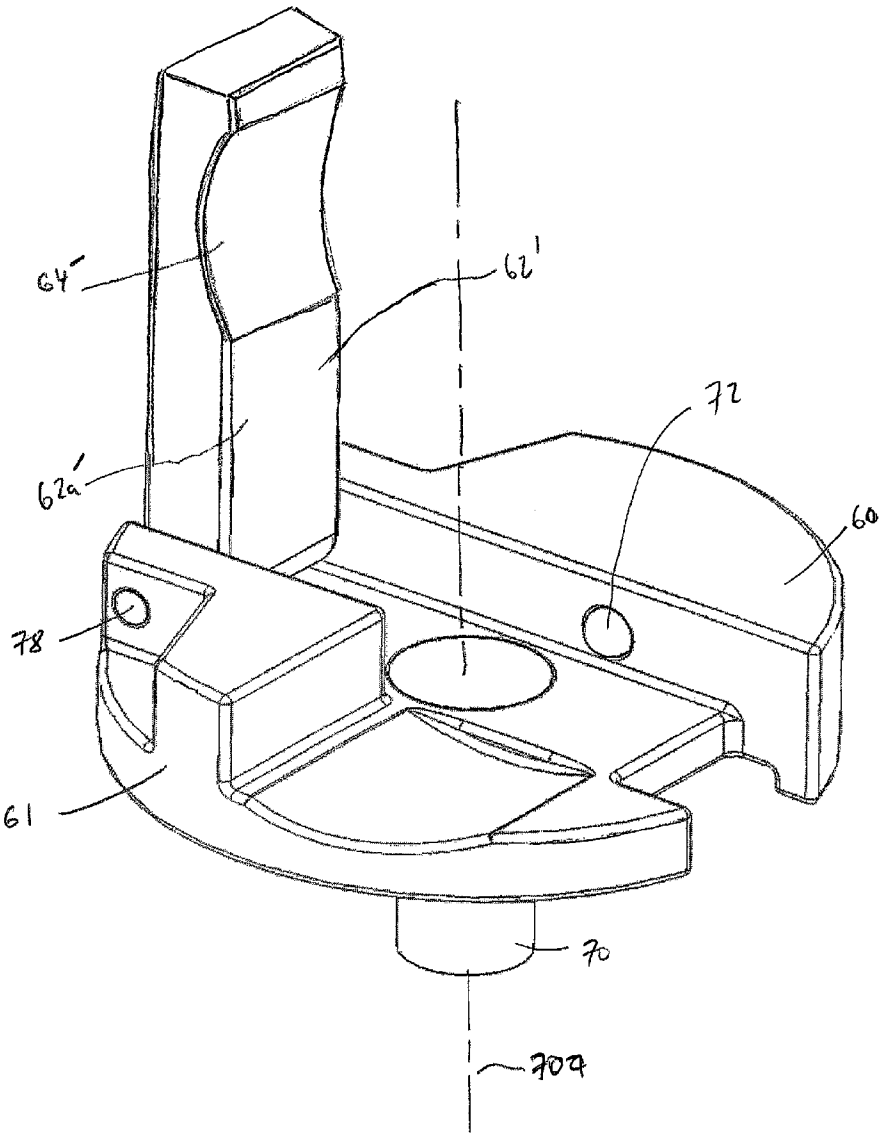
FIG. 6 is a perspective view of the lock with an alternate design of the arm, with the arm in a first position.
Figure 7:
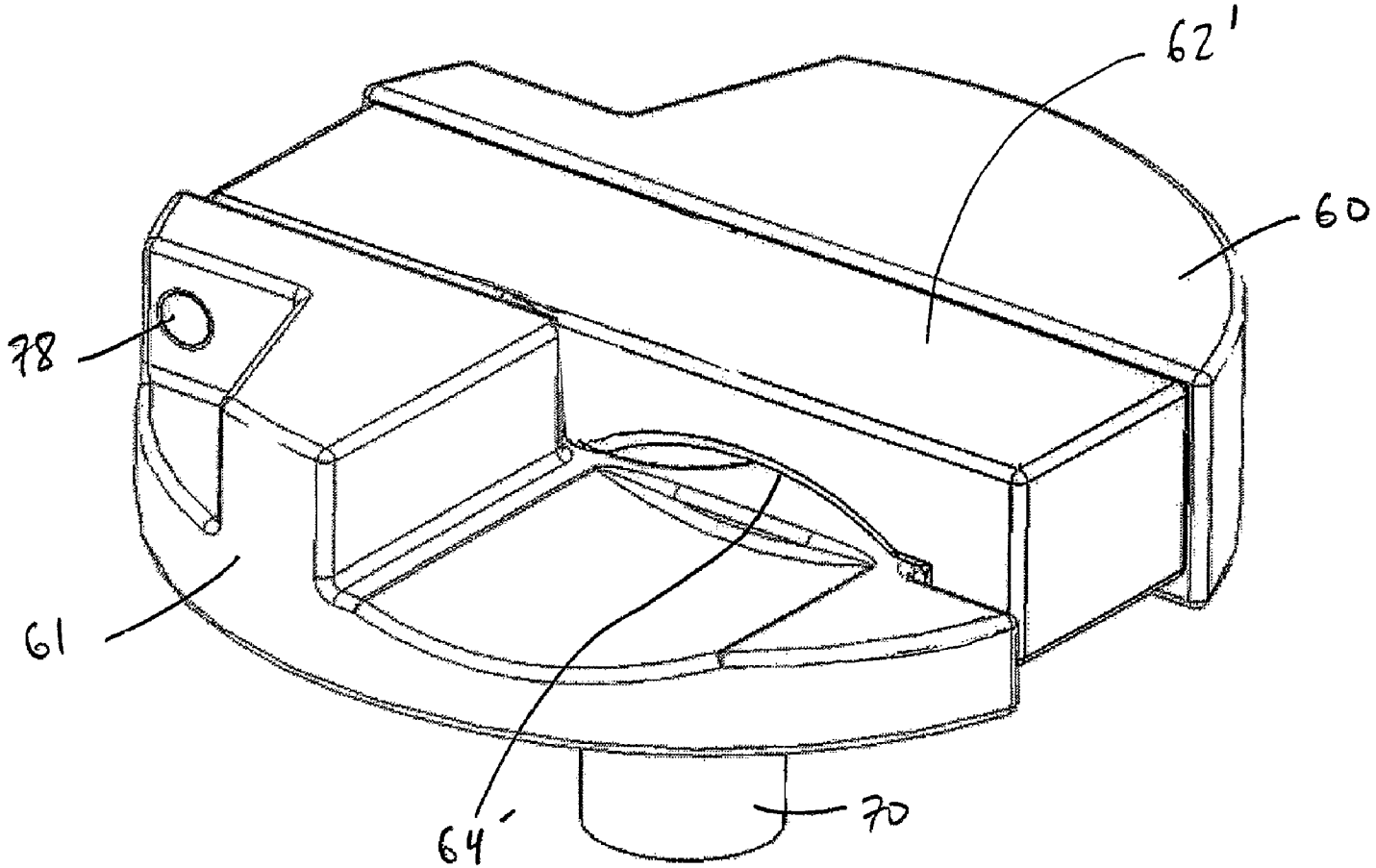
FIG. 7 is a perspective view of the lock of FIG. 6 with the arm in a second position.

It is preferred that the lock 60 be formed with both the arm 62 and the post 65 because this allows the arm 62 to extend further away from the longitudinal axis 70*a* of the projection 70 (which is the center of the lock body) to provide a larger moment arm than would be possible if the arm 62 was directly connected to the lock body 61. Although it is preferred that the lock 60 be formed with the arm 62 and the post 65, other embodiments are within the scope of the invention that include an arm 62' that is directly and rotatably connected to a lock body 61, as is shown in FIGS. 6 and 7. FIG. 6 shows the arm 62' in a position extending from the lock body 61 to rotate the lock 60 with respect to the spindle 44 and FIG. 7 shows the arm 62' contained within the outer dimensions of the lock body 61 for operation of the sander 10.

As best shown in FIG. 4, the lock body 61 includes a detent 72 that extends from a side wall of the lock body 61 into the cavity where the arm 62 is retained when the arm 62 is in the second position. The detent 72 is preferably a ball that is biased outward into the cavity by a spring. When the arm 62 is in the second position (shown in FIG. 5), the detent 72 engages a recess (not shown) located on the side surface of the arm 62. The engagement between the detent 72 and the recess provides mechanical stability to the arm 62 and the post 65 when these members are in the second position for use of the sander 10. Additionally, the engagement between the detent 72 and the recess produces an audible sound or click, which indicates that the arm 62 is stowed in the second position for use of the sander 10 on a workpiece.

Preferably, as best shown in FIGS. 4 and 5, the arm 62 includes a grip 64 that is formed as a recess on a portion of the lower surface of the arm 62 to aid in manipulating the arm 62. The grip 64 preferably corresponds with a recessed portion 61*b* in the lock body 61. The grip 64 and the recessed portion in the lock body 61*b* give the user room for their fingers to grab the arm 62 and rotate the arm 62 and the post 65 to the first position, shown in FIG. 4. As is understood by those of skill in the art, the grip 64 and the recessed portion 61*b* can be formed with a multitude of different geometries from the specific geometry shown in the figures to aid the user in rotating the arm 62 and the post 65.

In operation, a sheet of sandpaper is attached to the sanding pad 20 using methods that are known to those of ordinary skill in the art. The lock 60 is inserted into the aperture 24 in the sanding pad 20 such that the projection 70 from the lock 60 extends through the through hole 24*a* of the aperture 24 and the lock body 61 fits within the blind hole 24*b* in the aperture 24. The projection 70 is threadably inserted into the aperture 46 in the spindle 44 by manipulating the arm 62 that provides a moment arm to rotate the lock body with respect to the spindle 44. The arm 62 rotates the lock body 61 until the lock body 61 can no longer rotate with respect to the spindle 44. The arm 62 and the post 65 are then rotated with respect to the lock body 61 until the arm 62 and post 65 are positioned within the outer dimensions of the lock body 61. In embodiments that include the detent 72 on the lock body 61 and the corresponding recess on the arm, the user rotates the arm 62 and the post 65 until they sense the engagement between the detent 72 and the recess, either through feel on the arm 62 or through an audible noise or click that is made when the detent 72 has room to expand into the recess. The sander 10 can then be operated on the workpiece.

When necessary or desired the sanding pad 20 and the lock 60 can be removed. The arm 62 the post 65 are rotated to the first position shown in FIG. 4. This is aided by the grip 64 on the arm 62 and the recessed portion 61*b* on the lock body 61 that give the user finger room to rotate the arm 62 away from the lock body 61. When the arm 62 and post 65 are rotated, the lock body 61 can be rotated in the opposite rotational direction than the lock body 61 was rotated to install the sanding pad 20 onto the sander. The rotation of the lock body 61 is aided by the moment arm created by the arm 62 when it is in the first position, shown in FIG. 4. With sufficient rotation of the lock body 61, the projection 70 will be no longer inserted into the aperture 46 in the spindle 44 and the sanding pad 20 and lock 60 can be removed from the sander 10.

It is therefore intended that the foregoing detailed description be regarded as illustrative rather than limiting, and that it be understood that it is the following claims, including all equivalents, that are intended to define the spirit and scope of this invention.

What is claimed

1. A tool comprising:

a housing surrounding a motor and a spindle that includes an aperture, wherein the motor is operatively connected to rotate the spindle;

a moving surface that is capable of receiving and supporting a working member; and a lock including a body and a projection, the projection is inserted into the aperture in the spindle to connect the working member to the housing; wherein each of the aperture and the projection are correspondingly threaded;

further comprising an arm rotatably mounted to the lock body, wherein the arm can be rotated between a first position to rotate the lock with respect to the spindle and to a second position where the lock is rotatably fixed with respect to the spindle.

2. The tool of claim 1 wherein the arm is configured to provide a handle to allow for rotation of the lock body with respect to the spindle in the first position, and wherein the arm is contained within the lock body to prevent the lock body from rotation with respect to the spindle in the second position.

3. The tool of claim 2 wherein the connection between the arm and the lock body is with a post that is rotatable about the lock body and the arm is rotatable about the post.

4. The tool of claim 3 wherein a first surface of the post is substantially perpendicular with a top surface of the lock body when the arm is in the first position and the first surface of the post is substantially parallel to the top surface of the lock body when the arm is in the second position.

5. The tool of claim 3 wherein the post is rotatably connected to the lock body with a first pinned connection and the arm is rotatably connected to the post with a second pinned connection.

6. The tool of claim 1 wherein the arm and the lock body each include a cavity to allow the user to rotate the arm from the second position to the first position.

7. The tool of claim 2 wherein the arm includes a recess that is engaged by a detent extending from the lock body when the arm is in the second position.

8. The tool of claim 1 wherein the tool is a rotary tool.

9. The tool of claim 8 wherein the rotary tool is a sander.

10. The tool of claim 8 wherein the rotary tool is a buffer.

11. The tool of claim 8 wherein the rotary tool is a grinder.

12. The tool of claim 1 wherein the connection between the arm and the lock body is with a post that is rotatable about the lock body and the arm is rotatable about the post.

13. A tool comprising:

a housing surrounding a motor and a spindle that includes an aperture, wherein the motor is operatively connected to rotate the spindle;

a moving surface that is capable of receiving and supporting a working member; and a lock comprising a body and a projection, the projection is inserted in the aperture of the spindle to connect the working member to the housing, and an arm rotatably connected to the lock body with a post therebetween, wherein the arm is transferable between a first position away from the lock body to allow for rotation of the lock body with respect to the spindle, and a second position where the arm is within the outer dimensions of the lock body, wherein the post is rotatably connected to the lock body with a first pinned connection, and the arm is rotatably connected to the post with a second pinned connection.

14. The tool of claim 13 wherein the lock body is rotatably fixed with respect to the spindle when the arm is in the second position.

15. A tool comprising:

a housing surrounding a motor and a spindle that includes an aperture, wherein the motor is operatively connected to rotate the spindle;

a moving surface that is capable of receiving and supporting a working member; and a lock comprising a body and a projection, the projection is inserted in the aperture of the spindle to connect the working member to the housing, and an arm rotatably connected to the lock body with a post therebetween, wherein the arm is transferable between a first position away from the lock body to allow for rotation of the lock body with respect to the spindle, and a second position where the arm is within the outer dimensions of the lock body, wherein the arm further comprises a recess that is engaged by a detent extending from the lock body when the arm is in the second position.

16. A tool comprising:

a housing surrounding a motor and a spindle that includes an aperture, wherein the motor is operatively connected to rotate the spindle;

a moving surface that is capable of receiving and supporting a working member; and a lock including a body and a projection, the projection is inserted into the aperture in the spindle to connect the working member to the housing;

further comprising an arm rotatably mounted to the lock body, wherein the arm can be rotated between a first position to rotate the lock with respect to the spindle and to a second position where the lock is rotatably fixed with respect to the spindle.

* * * * *